US005915804A

United States Patent [19]

Crescenzo

[11] Patent Number: 5,915,804

[45] Date of Patent: Jun. 29, 1999

[54] EASY-ROLLING TV DINNER TABLE WITH HANDY PILL ORGANIZER

[76] Inventor: Amelita Crescenzo, 1240 Henderson Ave. Apt. 1, Sunnyvale, Calif. 94086

[21] Appl. No.: 08/918,998

[22] Filed: Aug. 27, 1997

Related U.S. Application Data

[60] Provisional application No. 60/025,347, Sep. 3, 1996.

[51] Int. Cl.[6] ..... A47B 88/00

[52] U.S. Cl. ..... 312/325; 312/300; 108/26; 108/187

[58] Field of Search ..... 312/325, 326, 312/249.1, 249.8, 249.11, 329, 300, 330.1, 348.5, 351.8; 108/25, 26, 177, 181, 189, 187, 176; D6/406, 422, 520

[56] References Cited

U.S. PATENT DOCUMENTS

| | | | |
|---|---|---|---|
| 981,529 | 1/1911 | Cantrell | 312/300 X |
| 1,455,506 | 5/1923 | Patey | 312/300 |
| 1,568,154 | 1/1926 | Hannon et al. | 108/26 X |
| 1,733,029 | 10/1929 | Plant | 108/189 |
| 1,803,804 | 5/1931 | Kolodny | 108/26 |
| 1,959,539 | 5/1934 | Latham et al. | 108/26 |
| 2,008,078 | 7/1935 | Martin | 108/26 |
| 2,146,413 | 2/1939 | Aron | 108/189 |
| 2,184,677 | 12/1939 | McKay | 108/26 |
| 2,387,030 | 10/1945 | Kolodny | 108/26 X |
| 2,508,802 | 5/1950 | Schade | 108/26 X |
| 2,608,454 | 8/1952 | Slattery | 108/26 |
| 2,754,167 | 7/1956 | Young | 108/26 X |
| 3,292,983 | 12/1966 | Service | 312/329 X |
| 3,575,483 | 4/1971 | Church | 312/325 X |
| 3,722,972 | 3/1973 | Deeds et al. | 312/325 X |
| 3,897,738 | 8/1975 | Minsky et al. | 108/119 |
| 4,729,616 | 3/1988 | Vogt | 312/325 |
| 5,337,682 | 8/1994 | Wiseman | 108/94 |
| 5,381,740 | 1/1995 | Johnston | 108/167 |
| 5,421,270 | 6/1995 | Kelly | 108/25 |
| 5,535,682 | 7/1996 | Aigeldinger | 108/25 |

OTHER PUBLICATIONS

Ikea Catalog, pp. 218 & 220, Jan. 1995.

McMaster–Carr Supply Company Catalog 98, p. 239, Dec. 1992.

*Primary Examiner*—Peter M. Cuomo

*Assistant Examiner*—James O. Hansen

[57] ABSTRACT

An improved snack table comprised of a rectangular table surface with a substantially horizontal width, a built-in glass holder located near the upper right edge of the table surface and a swing-out compartmented drawer, pivotally secured to the underside walls of the said table surface by a set of tilt-out hinges, to allow the drawer to be tilted out and back to an upright position within the frame. The table surfaces is rigidly supported by four angular legs which are mounted on casters. The legs are reinforced by leg braces and foot support strips, each extending horizontally at the base of the table thereby providing strong support and stability to the table.

4 Claims, 5 Drawing Sheets

EASY-ROLLING TV DINNER TABLE WITH HANDY PILL ORGANIZER

This application claims the benefit of U.S. Provisional Application No. 60/025,347, filed Sep. 3, 1996.

BACKGROUND—FIELD OF INVENTION

This relates generally to tables or the like and more specifically to an improved easy-rolling television dinner table set on swivel casters.

BACKGROUND—DESCRIPTION OF PRIOR ART

Dinner tables are presently available in a wide range of styles to fulfill different functions.

One form of collapsible dinner table currently on the market comprises a wooden frame into which is set and to which is secured a flat support surface that is decorated to be esthetically appealing. This prior art table is constructed with a pair of laterally spaced apart scissor-like legs that are joined together by a cross brace. The upper end or one of the leg in each pair of legs as pivotally secured in a suitable manner to a bar that is, in turn, adhesively secured to the underside of the snack tables so that fasteners do not extend through the decorated support surface. Thus, when in storage, the support surface and the frame therefore may be folded downwardly to assume a position alongside the collapsed legs.

Indicia dividing a table platform surface into plural segments as seen in U.S. Pat. No. Des. 88 355, issued on Nov. 22, 1932 to Lee D. Jalkut. The entire tabletop is so divided.

Indicia providing animate features on a table is shown in U.S. Pat. Nos. 122,286, issued to Gorman L. Fisher on Sep. 3, 1940, 267,214, issued to Henry Orenstein on Dec. 14, 1982 and 272,169, issued to John R. Nottingham et al, on Jan. 10, 1984. The inventions of Nottingham et al, '169, and Fisher '286 are directed to adornment of tabletops. The forms also divides a portion of the tabletop into segments, those divisions occurring in the center of the tabletop.

A typical snack table is small—tray—like size and light weight which could easily be knocked down or tipped over, spilling everything on the floor.

The concept of a short-legged table is illustrated to U.S. Pat Nos. Des. 24, 421, issued to Paul F. Schafer on Jun. 25, 1895; 44,113, issued to John E. Rohrbeck on May 27, 1913; 143, 312, issued to David Harriton on Dec. 25, 1945; 148,947, issued to Norman E. Olin on Mar. 9, 1948, 265, 026, issued to Jan M. Macho et al. on Jun 22, 1982; and U.S. Pat. Nos. 3880,091, issued to George W. Heinonen on Apr. 29, 1975.

Tables have been designed to be folded or disassembled for storage or conversion to another configuration in the prior art. U.S. Pat. No. 2,936,896, issued to Samuel Friedman on May 17, 1960, platform surfaces formed into two parts and being foldable along a common joint existing between the two parts. In both cases there are supporting struts or the like attached to the legs.

The stools of Machoetal. '026 is disclosed as being foldable, but no hinging of the table platform.

A knock-down table having a table having a table platform formed in plural parts is seen in French Pat. Document No. 1,072,794, dated Sep. 15, 1954. The plural parts separate when the table is dismantled, and are not mutually hinged.

Another prior art with U.S. Pat No. 5,337,682 issued to Russell B. Wiseman on Aug. 16, 1994, is a television snack table which includes a lower top, a set of legs connected to the lower top for supporting the lower top above a horizontal support surface, and an upper top disposed above the lower top for providing a tabletop surface. A mounting component connected to the upper and lower tops rotatably mounts the upper top on the lower top in order to enable a user to rotate the upper top relative to the lower top above a generally vertical axis of rotation. This type of table enables the user to eat while watching TV from a relaxed position in a living room couch or chair-a position which is reclined backwardly somewhat. A reclined position while eating will have gravity against the user causing acid reflux. Digestive juices normally found in the stomach back up out of the stomach into the esophagus (tube that connects the mouth and the stomach). Since esophagus has no protective lining unlike the stomach, it succumbs to the upwardly mobile stomach acid causing heartburn. So, healthwise, a snack table that encourages a user to sit upright while eating and watching the TV at the same time, is a better choice rather the above described prior art. Still another feature of this type of table is the counterbalancing footrest which spans the legs most distant from the user so that the user's feet has to hold it down to prevent the table from tipping over.

None of the above inventions and patents, taken either singly or in combination is seen to describe the present invention as claimed.

SUMMARY OF THE INVENTION

It is a principal objective of the present invention to improve in order to provide more comfort to the user. To fulfill this purpose, the TV dinner table is so designed for complete mobility. It rolls gracefully to your side on sturdy casters, making this type of table an easily transportable unit. You can move it next to the wall when you want added floor space or can push into the center of the area where you need it like watching the TV while having your dinner.

Another objective of the invention is to provide stability, wherein the tabletop is supported by four substantially stable legs set on sturdy metal casters and reinforced with leg braces and foot support strips.

The improved invention has a bigger tabletop surface-spacious enough to accommodate a five-course meal.

An ingenious and novel feature of the invention is the pill organizer which consists of a hinged swing-out drawer with small compartments located at the side of the tabletop. The swing-out drawer is supported by a pair of hinges, thereby allowing the drawer to swing out and swing back. Just put a supply of each supplement into each storage compartment and store. It is out of the way, yet always available. It is an ideal handy forget-me-not pill organizer.

Another novel feature of the invention is a built-in glass or cup holder located at the right-hand corner of the tabletop. It supports a glass or cup firmly, thus avoiding spillage.

Still another feature of the invention includes foot support strips located at the lower part of the table which provide spacious and comfortable footrest for the user to ease foot tension while having dinner.

The height of the table is so designed to allow a user to sit in an upright position healthwise, and still give enough clearance for the users legs under the table and the feet to relax comfortably on the foot support strips. The height of the table mates well with conventional chairs.

The present invention is made of solid maple wood, finished with a clear satin coating, producing an attractive and smooth finished appearance.

Accordingly, it is an object of the present invention to provide a versatile table capable of different functions namely: TV stand, or crafts, paperwork, tea cart, end table, telephone stand, magazine rack, portable sewing machine, typewriter table, bedside table, and even for card games. This style of table is ideal for the handicap and for arthritic users.

The foregoing and objects, features, and advantages of the invention become more apparent upon reading the following detail description with reference to the illustrative drawings.

REFERENCE NUMERALS IN DRAWINGS

Figure 1:
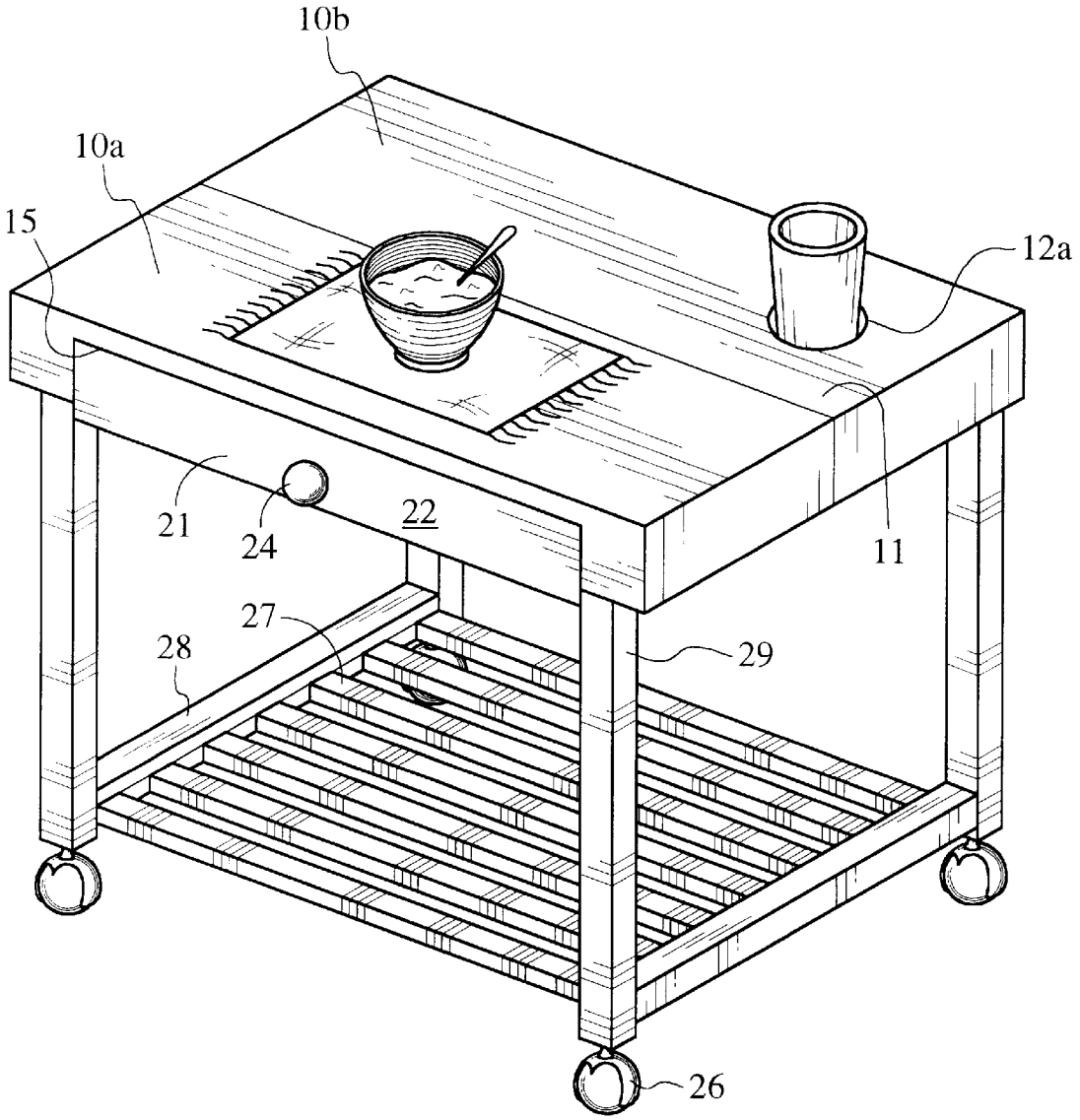
FIG. 1 is an overview of the improved dinner table.

11 Tabletop 10-A One piece of tabletop (front)
10-B Other piece of table top (rear)
12 Built-in glass holder hole
12-A Built-in glass holder
13 Glass holder block
14 Side edge band (left side)
15 Notched front edge band
16 Side edge band (right side)
17 Rear edge band
18 Hinge
19-A Part of lilt-out tray hinge (screwed to edge band)
19-B Part of hinge screwed to back of drawer
20 Divider or partition of drawer
21 Compartmented drawer or tilt-out tray
22 Drawer front (front)
22-A Drawer front (interior front)
22-B Drawer front (interior rear)
22-C Drawer front (interior bottom)
22-D Drawer front (divider of drawer)
23 Compartment (individual)
24 Black knob
25 Block glued and nailed to drawer for hinge attachment
25-A Block attached to edge of bands 14, 16 for hinge attachment
26 Black casters (4 pieces)
29 Leg (4 pieces)
28 Leg brace
27 Foot support strips (7 pieces)

DETAILED DESCRIPTION OF THE INVENTION

With reference to the figures, FIG. 1 is an overview of a dinner table in accordance with my current invention. It illustrate a table structure of rectangular shape which preferably is of solid maple wood. Height of the table including casters measures 27½" and table top measures 17"×22" . The table top has a substantially vertical support members which are provided with casters, making this type of table an easily transportable unit.

All materials are cut to size according to the following bill of materials:

| Part Description | Size | Number Required |
|---|---|---|
| Table top | 13/16" × 7 3/4" × 20 1/2" | 2 pcs. |
| Edge band (Front and back) | 13/16" × 3 1/2" × 22" | 2 pcs. |
| Edge band (side) | 13/16" × 3 1/2 × 17" | 2 pcs. |
| Legs | 1 1/2" × 1 1/2" × 24" | 4 pcs. |
| Leg braces | 1 1/4" × 1 1/4" × 12 1/4" | 2 pcs. |
| Cup or glass holder block | 13/16" × 4" × 6" | 1 pc. |
| Foot support strips | 13/16" × 1" × 19 1/4" | 7 pcs. |
| Drawer front A | 13/16" × 3" × 8 1/4" | 1 pc. |
| Drawer front B | 1/2" × 2 1/2" × 16 3/4" | 1 pc. |
| Drawer back | 1/2" × 16 3/4" × 1 3/4" | 1 pc. |
| Drawer bottom | 1/2" × 16 3/4" × 4" | 1 pc. |
| Drawer divider | 1/2" × 2" × 4 × 1 1/2" | 5 pcs. |
| Drawer ends | 2 1/4" × 2" × 4" | 2 pcs. |
| Block attached to drawer for hinge installation | 1/2" × 4" × 1/2" | 2 pcs. |
| Swing-out drawer or tilt-out tray with 6 compartments | 2" × 16 1/2" × 1 3/4" | 1 Pc. |
| Tilt-out tray hinge | (part no. AMCM84-26) | 1 pair |
| Black casters (metal) | | 4 pcs. |

Note:
Use 1/4" round overbit on all edges.

Figure 2:
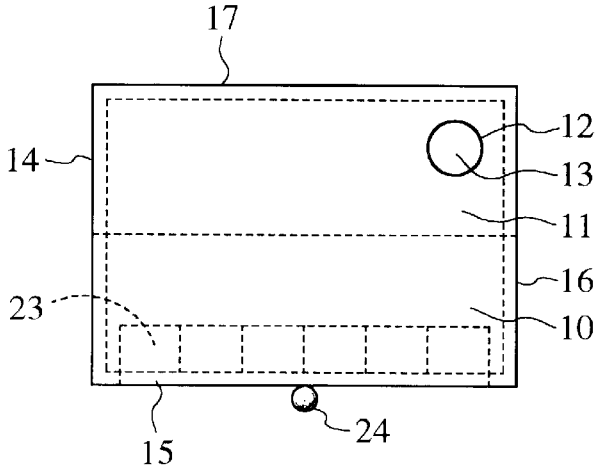
FIG. 2 is a top view of the tabletop surface.

FIG. 2 As shown in the drawing, a table top is comprised of 2 pieces of solid maple wood 10 A and 10 B measuring 13/16" (wood thickness)×7¾"×20½"). Dowel and edge glue 2 pieces together to form the table top surface. When dry, drill a 3" hole 12 with 1" depth on posterior right-hand corner, one inch from edge of table top 10 B. The glass or cup holder block 13 (13/16"×4"×6") is glued in under the 3" hole 12A to form the built-in ass holder 12A.

Figure 3:
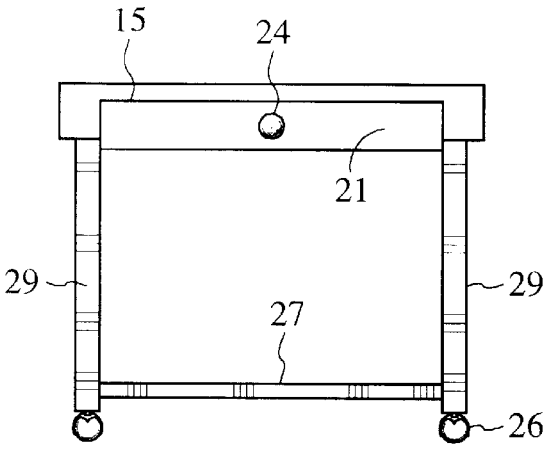
FIG. 3 is a front view of the novel table.

FIG. 3 Mitre or cut 45° both ends of edge band 15 (13/16"×3 ½"×22"). Notch the said part 2 ⅝"×17¼" in center of the board 15 for the drawer or tilt-out-tray 21.

Figure 4:
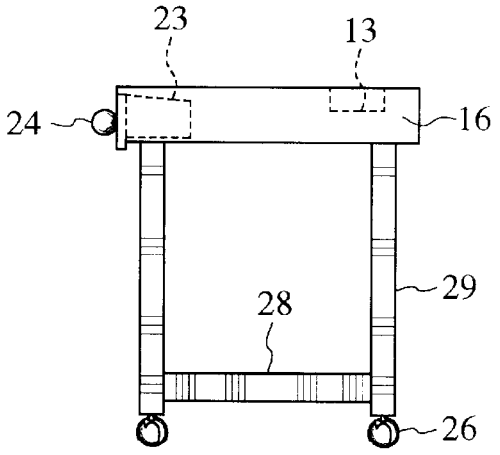
FIG. 4 is a cross-sectional view of the table.

FIG. 4 Glue and nail 4 edge bands. 14, 15, 16, 17, around the table top 11.

Figure 5:
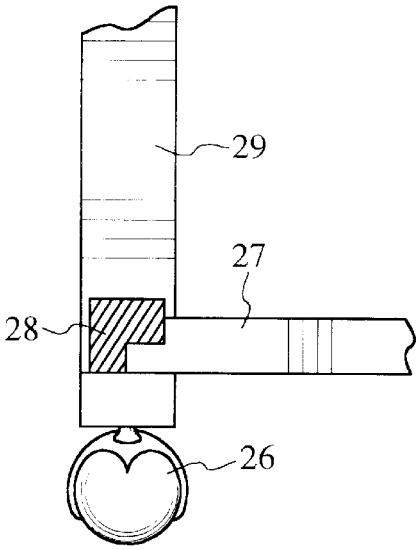
FIG. 5 is an exploded side view of the lower portion of the table.
Figure 7:
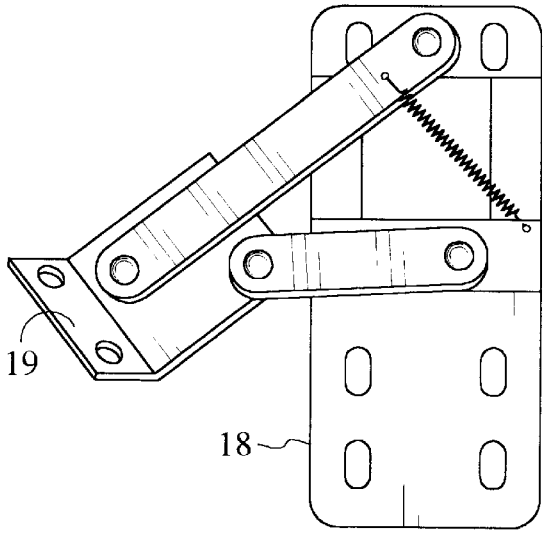
FIG. 7 is an enlarged view of the tilt-out tray hinge.

FIG. 5 Notch leg braces 28. Also dowel side of 4 legs 29. Glue together and allow to dry.

FIG. 2, FIG. 3, FIG. 4 Glue legs to table top 11 and edge bands 14, 15, 16, 17. Then nail them together.

FIG. 1, FIG. 3, FIG. 5 Notch seven-piece foot support strips 27 (13/16"×1"×19¼") and drill for screws. Screw and glue strips 27 to leg braces 28 with ¾" spacing between strips.

FIG. 3 Sand tabletop 11 and edge bandings 14, 15, 16, 17.

Figure 8:
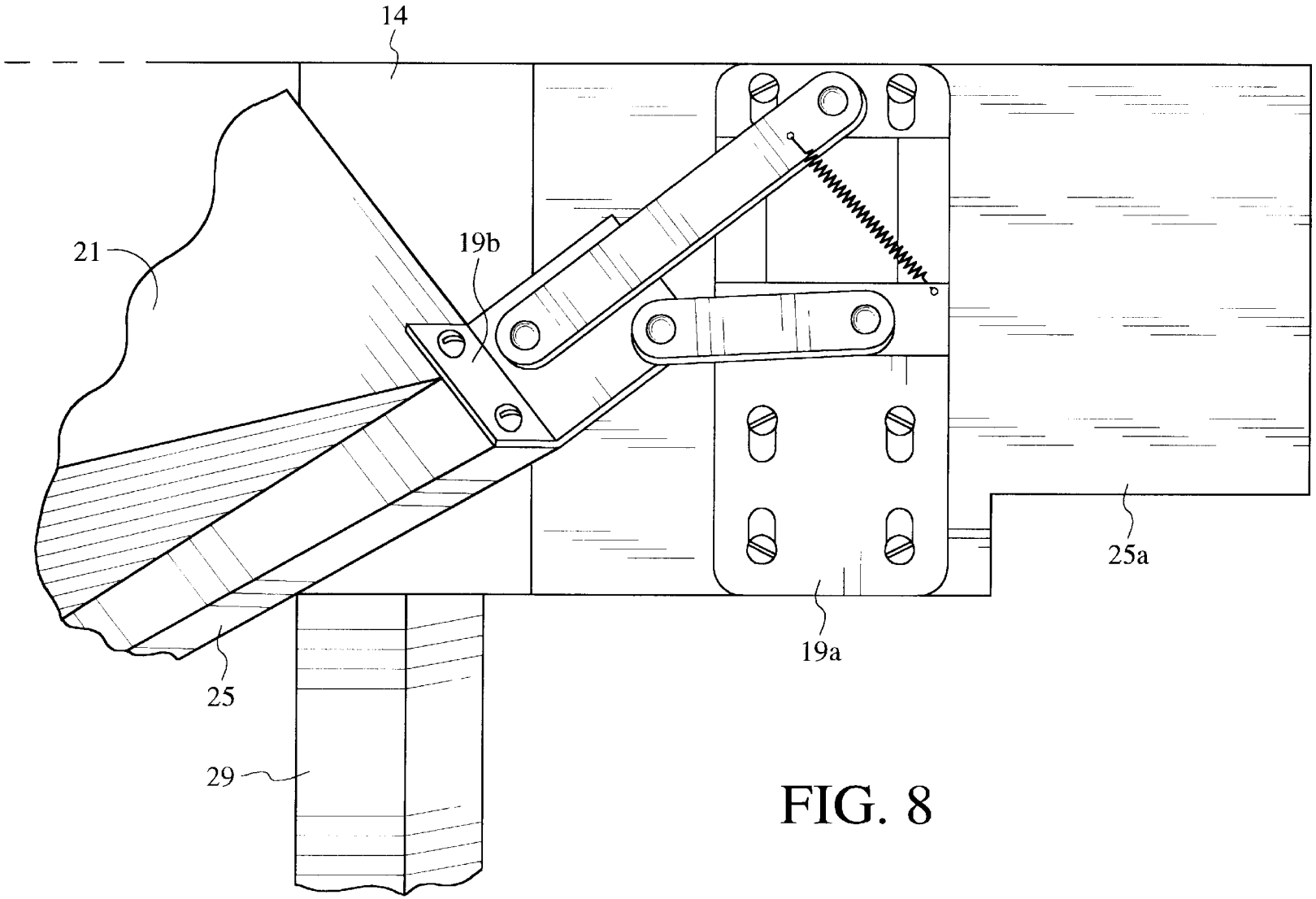
FIG. 8 is an exploded view of the hinge mechanism.

FIG. 8 Glue and nail block 25A (1½"×2½×3") to inner side of edge bands 14, 16 for hinge attachment.

Figure 6:
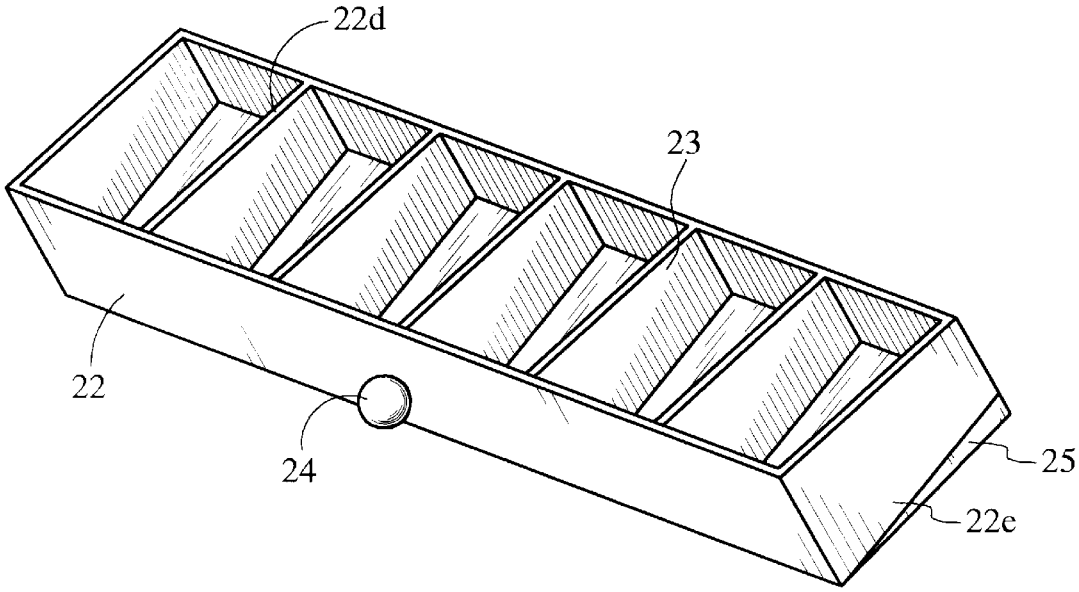
FIG. 6 is an exploded view of the swing-out drawer or tilt-out tray of the table.

FIG. 3, FIG. 6 Build drawer 21 According to opening dimensions 15 and just divide into six compartments 23. Drawer 21 is 16¾" (width)×4" (length of drawer)×2½" (height of drawer at the front). Height of drawer 21 tapers at the back to 1¾". There are six compartments 23 and each compartment is 2¾" wide, and each divider 22D is ½" thick.

Glue and nail divider 22D. Also glue and nail block 25 (½"×4"×½) to drawer bottom 22C (outside) on both sides on hinge attachments).

FIG. 8 Mount drawer 21 onto the hinge 19A and 19B. The tilt-out tray is available in hardware stores particularly at CHS Wholesale Hardware or at E. B. Bradley Company in San Jose, Calif., with part number AMCM8488-2G. The hinge 19 allows the drawer 21 to be pulled out of swung back and forth FIG. 1 Fill nail holes with putty and finish sand. Drill all casters 26 on four legs 29 and screw knob 24 on the drawer front 22. Apply clear satin finish.

Description of Operation

FIG. 1 As shown in the drawings, the preferred dinner table is designed with four stable legs 29, set on sturdy black metal swivel casters 26 for complete mobility and ease of transport. It can be moved next to the wall when added floor space is needed or it can be pushed into the center of the area where it is needed. It rolls out easily to your side. The table top 11 is made of solid maple wood for durability. The said part is spacious enough to accomodate a five-course dinner. The table top 11 includes a built-in glass or cup holder 12A located at the posterior right hand corner of the table to support a glass or cup firmly thus, avoiding spillage. The table includes also a swing-out compartmented drawer or tilt-out tray 21 which is supported with a pair of tilt-out tray hinges 19.

Figure 9:
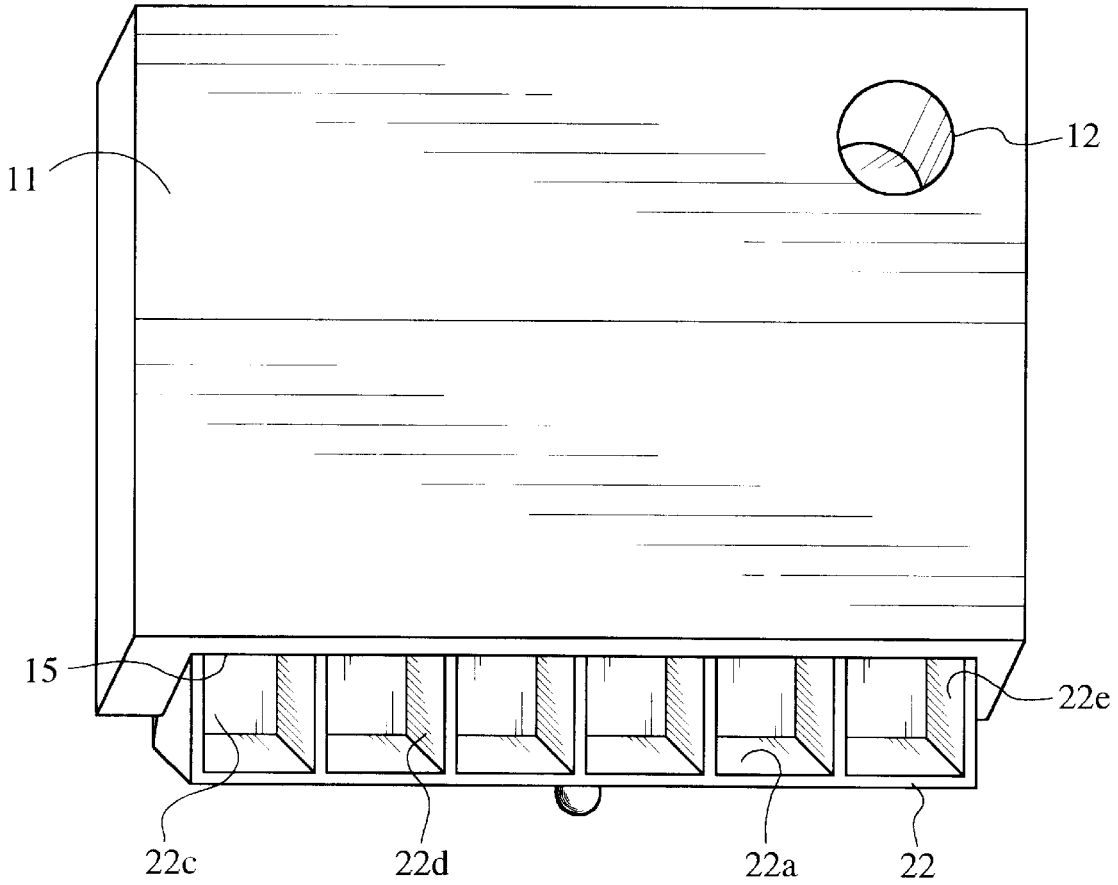
FIG. 9 is a top elevation of the novel table showing the compartment drawers.
Figure 9:
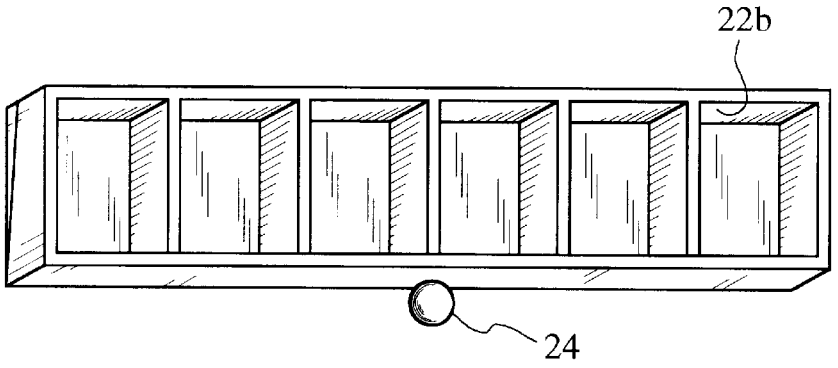

FIG. 8, FIG. 9 The hinges are screwed to edge bands 14 and 16 on both sides which allow the swinging back and forth of the drawer 21. Five dividers 22D and two drawer sides 22E are mounted and glued to the drawer 21 forming six compartment. This type of drawer with compartment 23 is an ideal handy forget-me-not pill organizer. It stores pills and tablets by dosage as the user prefers. It eliminates bottle cap struggles and general confusion. Just put a supply of each supplement into each storage compartment and store. It's out of the way, yet always available. If you take more than one pill a day you can't be without this ingenious organizer. A black plastic knob 24 is screwed at the center of the drawer front 22 to serve as a handle to pull and push the drawer 21.

FIG. 1, FIG. 3, FIG. 4, FIG. 5 The seven-piece foot-support strips 27, the four legs 29, and a pair of leg braces 28, all provide strong support and stability to the table. The foot-support strips 27, located at the base of the table provide spacious and comfortable footrest for the user to ease foot tension. The said part can also be used as a magazine rack.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitution of parts and elements without departing from the spirit of the invention.

What is claimed is:

1. A TV dinner table comprising: vertically oriented front, back and side walls surrounding a horizontal table surface, said walls and table surface being joined together forming a rectangular table structure for supporting objects; a plurality of elongated support members joined to said table surface at right angles and spaced apart to support said table surface horizontally; a swing-out compartmented drawer located in the front wall and pivotally connected to the table structure by hinge mechanisms permitting the drawer to be tilted out and then back into the structure, whereby an upright position is maintained; a circular opening provided in said table surface and equipped with a circular block underneath said opening for supporting a glass; and a plurality of support strips attached near distal ends of the support members for adding stability to said structure.

2. A TV dinner table according to claim 1, wherein said table surface is comprised of two sections, rigidly secured together.

3. A TV dinner table according to claim 1, wherein said compartmented drawer consists of a front having a knob, a rear, drawer dividers and drawer sides connected together forming a drawer frame, said drawer tapers in height from front to rear.

4. A TV dinner table according to claim 1, further comprising casters attached at the distal ends of said support members.

* * * * *